United States Patent [19]

Harris

[11] Patent Number: 4,741,180

[45] Date of Patent: May 3, 1988

[54] TERRYING MECHANISM FOR DOUBLE CYLINDER KNITTING MACHINE

[75] Inventor: Denis Harris, Leicester, United Kingdom

[73] Assignee: Stuart Frederick Jones, Leicester, England

[21] Appl. No.: 804,263

[22] Filed: Dec. 3, 1985

[51] Int. Cl.[4] ..... D04B 9/10; D04B 9/12

[52] U.S. Cl. ..... 66/14; 66/91

[58] Field of Search ..... 66/14, 91, 93

[56] References Cited

U.S. PATENT DOCUMENTS

| | | | |
|---|---|---|---|
| 1,770,469 | 7/1930 | Grieve | 66/14 |
| 2,292,941 | 8/1942 | Holmes | 66/14 |
| 3,107,509 | 10/1963 | Farmer | 66/14 |
| 3,174,305 | 3/1965 | Swaim et al. | 66/14 |
| 3,283,539 | 11/1966 | Peberoy | 66/14 |

FOREIGN PATENT DOCUMENTS

| | | | |
|---|---|---|---|
| 647402 | 10/1962 | Italy | 66/14 |
| 46-28984 | 8/1971 | Japan | 66/14 |

*Primary Examiner*—Wm. Carter Reynolds

[57] ABSTRACT

A terrying mechanism for mounting on that one of the two cylinders (2) of a double-cylinder knitting machine, through which fabric is not removed from take-down. The mechanism includes a pillar (22) adapted for journalling at one end on a part (14) at the base of the cylinder (2) rotating jointly therewith and carrying at the other end an annular cam system (20) with a retractable cam means (55) for coacting with terrying instruments (90, 91, 94) carried in generally radially extending tricks (60) in a dial (62) having a journalling means (68) in axial alignment of the pillar (22).

30 Claims, 3 Drawing Sheets

TERRYING MECHANISM FOR DOUBLE CYLINDER KNITTING MACHINE

Figure 1A:
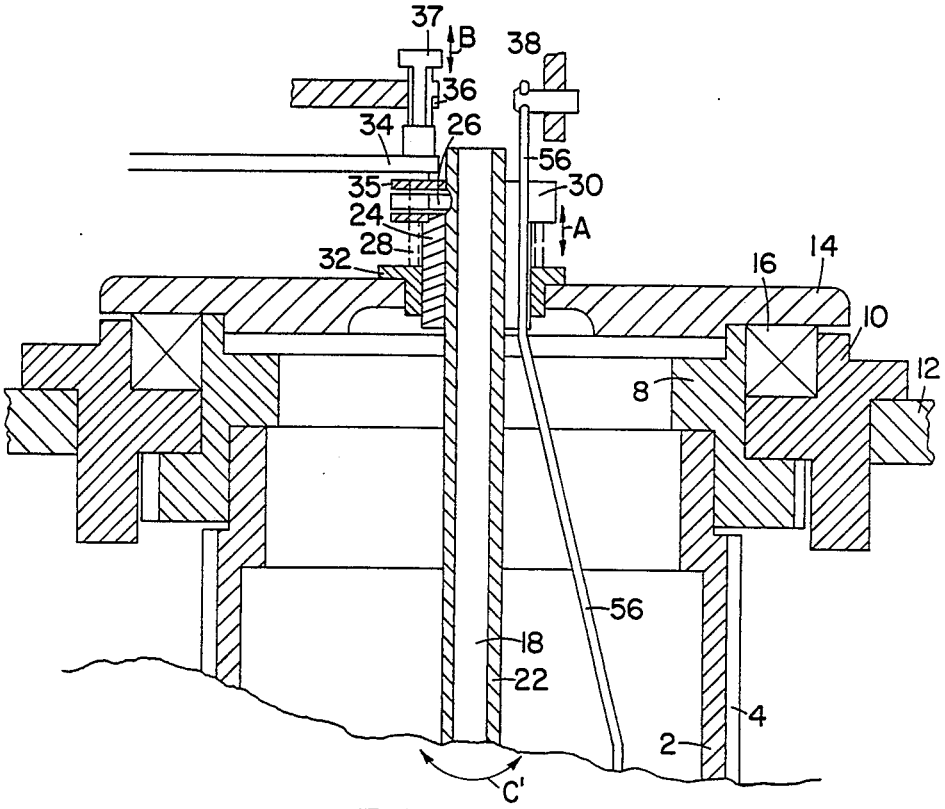

DESCRIPTION:

1. Field of Invention

The invention relates to terrying mechanisms for double cylinder machines. The mechanicms may be sold as attachments for converting existing double cylinder machines or may be designed and constructed to be part of original equipment.

2. Background of Invention

The British Patent Specifications Nos. 567,620, 630,847 and 646,283 described terrying mechanisms in which dials carrying terrying instruments are mounted inside the upper needle cylinder, the dial being moved around by the cylinder and cams for the instruments being mounted on a shaft extending centrally of the upper cylinder. The shaft resembles in function that used also in British Patent Specification No. 1,050,487 to hold a cam system for axially movable knockover bits.

The dial-like construction did not become commercially established. In modern terrying machines loops are drawn by terrying instruments located inside the top cylinder, parallel to the needles and rockable by cams at the base of the cylinder (i.e. the top portion of the upper cylinder) to project or retract terry loop forming ends moving between the needles and the superimposed needle cylinders.

It is suspected that the dial-like construction was unsatisfactory because no take down force was exerted during reciprocatory knitting of a heel pouch, because of the apparent need to provide a terry loop holding instrument and a knockover verge for knitting in the top cylinder, and complex or inadequate connection between the upper cylinder and the dial driven by it. Where British Patent Specification No. 567,620 suggests all-around terrying and use of the lower edge of terrying instruments as a knockover verge (p8, lines 6–42, FIG. 7) no physical positive connection between the upper cylinder and dial is described.

It is amongst the aims of the invention to provide a terrying mechanism using the internal dial-like arrangement avoiding most or all of the drawbacks of such known arrangements and performing better than commercially established terrying mechanisms with rockable terrying instruments.

It is also amongst the objects to permit standard upper cylinder construction to be used in conjunction with such terrying mechanisms and to extend the range of machine types to which terrying may be applied on double cylinder machines.

SUMMARY OF INVENTION

The invention firstly provides a terrying mechanism for mounting in one cylinder of a double cylinder knitting machine, the mechanism having a hollow pillar for arranging axially and non-rotatably in said one cylinder, an annular cam system mounted on the pillar and having a retractable cam means, a dial having radial tricks carrying terry instruments for controlling by the cam system, for coupling to the cylinder, a hollow stub aligned with the pillar on the dial for mounting the dial rotatably on the annular cam system and a key on the hollow stub for engaging a pouch tensioner whose shaft extends through the pillar and the stub. Because the dial and cam system are mounted on one another and mutually aligned by the hollow stub, optionally with the aid of a bearing, the dial/cam assembly can be mounted simply by coupling the dial to the cylinder and holding the pillar against torque during relative rotation of the dial and cam system. In addition the invention leaves a clear path for the of the pouch tensioner shaft and simply drives the tensioner for rotation thus permitting a good take down action after the knitting of heel or toe pouches in a manner not possible in the prior art dial-terry instrument machines.

Preferably the dial is arranged to be coupled to the cylinder by coupling means having a ring for fastening concentrically to the dial against free ends of trick walls and a key means in the ring for providing conjoint cylinder and dial rotation. In a particular convenient construction the ring and trick walls have mutually engaging shoulders for centering the ring and dial relative to each other, and the trick walls have a projection with an undercut to permit clamping means to fasten the ring and dial together in any desired angular relationship and the ring is arranged to locate concentrically with respect to the cylinder but free to move axially with the dial and cam system. This dial-cylinder coupling arrangement simultaneously provide a strong mutual driving engagement, adjustment of the terry instruments with respect to the needles to ensure proper gating, vertical terry instrument adjustment during knitting, and centralisation of the dial-çam system assembly.

Suitably the hollow stub is separatable from the dial and the dial is retained against axial movement with respect to the cam system by a member secured to the stub on the opposite side of the dial. Preferably the dial has a central recess for receiving the tensioner disk, the tricks are angled with respect to the axis, and the terry instruments have wire-like outward projecting ends for engaging terry loops or acting as knockover verges. The pouch tensioner, when retracted to its inactive position, is hence clear of the fabric take-down path, and the instruments can easily fulfill the dual role of holding up terry loops and assisting in knock-over of rib-loops.

Other advantageous features are set out in the appendant claims.

DRAWINGS

Figure 2:
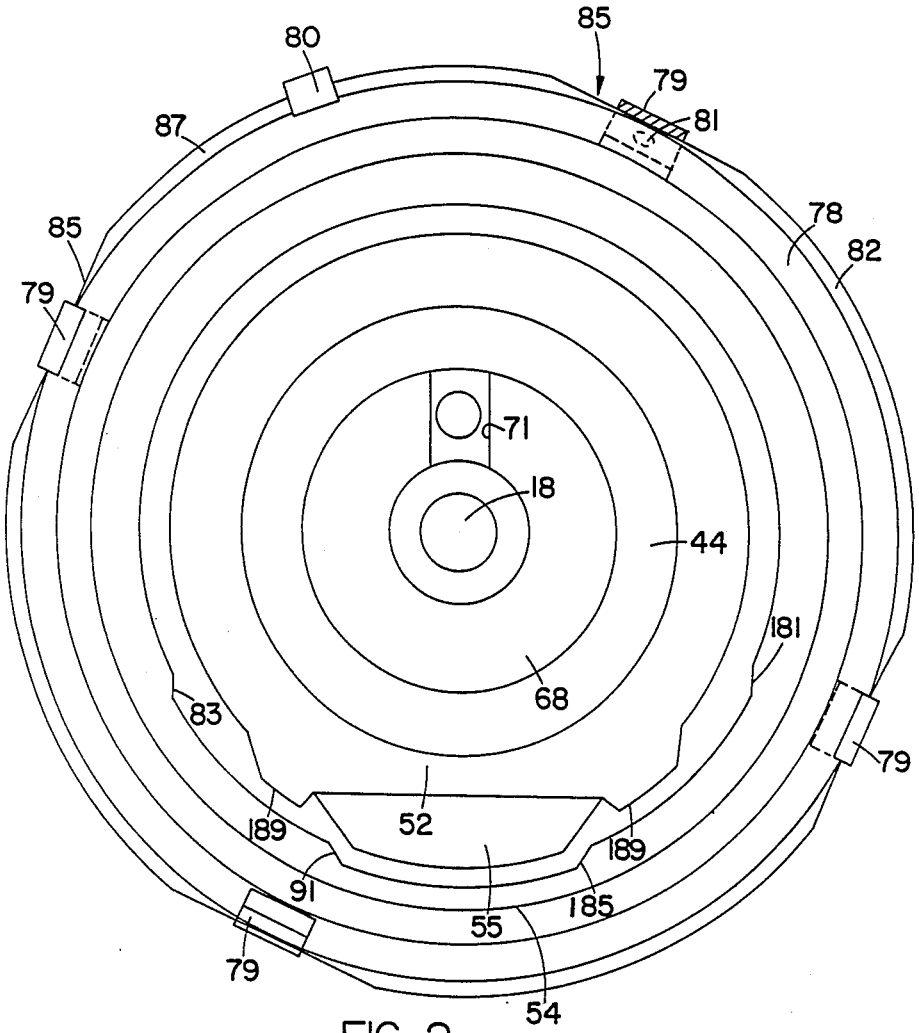

FIG. 1A is a section through a top part of a top cylinder of a double cylinder knitting machine having a terrying mechanism according to the invention, FIG. 1B is an enlarged section through a bottom part of the top cylinder of FIG. 1A, and FIG. 2 is a plan view of an annular cam system of the mechanism of FIG. 1 from below also showing part of a coupling arrangement for connecting a dial of the terrying mechanism to the top cylinder.

DESCRIPTION WITH REFERENCE TO DRAWINGS

With reference to the Figures, a double cylinder knitting machine has a top cylinder adapted for knitting terry loops. The parts which are the same as those found on a normal double cylinder machine are the top cylinder 2 which has tricks 4 and an internal keyway 6, a drive gear and inner bearing support 8 which is fast to the cylinder 2, an outer bearing support 10 which has a flange for fastening to a top cylinder bed plate 12, and a top plate 14 fastened to the inner bearing support 8 to clamp the bearing 16 into place. The top plate 14 normally has a central hole for supporting the shaft of a verge support (not shown) and this opening may have to be enlarged for the purposes of the present invention. The top cylinder 2 is also equipped with a heel or toe pouch tensioner commonly referred to as dropper 19 for passing through dropper opening 18. The dropper includes an upright stem 21 with an elongate keyway 23 and a disc 25 with radially extending points 27 at the bottom for bearing down on the fabric knitted after formation of a heel or toe pouch in order to aid the take-down of such fabric. Toe-pouch tensioners are generally of a star-like configuration as seen from above and have a number of points. Some such points are indicated generally in FIG. 1B at 27, 27. Projection of the terry instruments occurs prior to knockover in either direction of cylinder rotation.

Using the invention, the post and casting mounting the verge bits, normally present, are omitted and replaced by a mechanism for terrying. This mechanism includes a cam system generally indicated at 20 mounted on an upright pillar 22 extending through the top plate 14 of the cylinder assembly. Above the top plate 14 (FIG. 1A) an inner bush 24 is secured to the top end of the pillar 22 and located vertically by means of a grub-screw 26. A spring 28 is located on an outer bush 32 fitted into the hole in the top plate 14 and urges the pillar and cam support 20 upwards. The inner bush 24 has a groove 30 to permit the cam system 20 inside the top cylinder 2 to be controlled. A link 34 is fastened to a pin or pins 35 in the inner bush 24 to hold the pillar 22 and the attached cam system 20 against rotation. The link 34 is adjustable arcuately in the direction. The pin 35 is offset from the central axis of the pillar 22 and cylinder 20 so that the angular position of the cam system 20 can be achieved by rotating the pillar 22 until cam system 20 is achieved by rotating the pillar 22 until cam system 20 is adjusted accurately as shown by arrow C' by moving the pillar 22 and consequently cam system 20 in the direction of arrow C by moving link 34 in the direction of arrow C. A member 36 with an adjustable screw 37 is fixed over the inner bush 24. The screw 37 pushes against the bias of the spring 28 and so conrols the height of the cam system 20 inside the top cylinder 2. The member 36 may be moved automatically during the manufacture of a sock to vary the terry loop length. Also the screw 37 may be turned to permit the lengths of the terry loops to be accurately adjusted along arrow B. A member 38 is operated in the direction of arrow A by a cam drum of the kitting machine, not shown so as to control which of the different operational modes of the cam system should be made effective.

It is to be noted that all the controls for the setting of the height and angular position of the cam system and its different modes of operation are located above the top plate 14. They are therefore readily accessible and can be accomodated without interfering with other knitting machine functions.

At the lower end the pillar 22 is formed with an integral flange 40 having a number of screws (not visible in Figure 1B) for fastening the pillar 22 to a cam mounting plate 44 of the cam system 20. The cam mounting bare plate 44 has an annular groove for accurately locating the end of the flange 40. The plate 44 is generally disc-shaped but has a cut-out or slideway 46 for receiving a bolt cam 55. A pin 48 is secured in the plate 44 and holds the bolt cam 55 against the plate 44. The bolt cam 55 is urged downwards by a spring means 50. The plate 44 also mounts on its underside in appropriate annular grooves a continuous annular inner cam ring 52 and an annular outer cam ring 54 by screws such as 57. A rod 56 connected to stud 58 in the bolt cam 55 joins the bolt cam to the cam drum operated member 38 so that the bolt cam 55 can be pulled up or down to varying degrees against spring tension. The outer cam ring may have a door or slot to enable terry instruments to be replaced.

A dial 62 forming a bed for terry instruments and having tricks 60 is mounted underneath the cam system 20. The dial 62 carries a key 64 secured by screw 66 for engaging in the longitudinally extending keyway 23 in the dropper 19 passing through the central opening opening 18. This ensures that the radial pointed projections 27 at the lower end of the dropper are rotated or reciprocated conjointly with the dial 62. The dial 62 is journalled on the plate 44 by a stub shaft or bush 68 which engages in a corresponding aperture in the plate 44 and is retained against vertical movement thereon by a thrust member 70 pinned and bolted to the stub 68 by a pin and screw 72. The stub 68 is hollow and has a slot 71 for receiving the dropper key 64. Fastening means 65, similar to screw 66, but help to secure the stub 68 to the dial 62. A washer 63 or other bearing members may be used to facilitate relative movement.

This arrangement ensures that the dial 62 with the terry instruments is accurately centered for rotation with respect to the cam plate 44 on central axis 100.

Trick walls 74 of the dial 62 have at their radially outer end an upstanding elevated trick wall portion 76 which has an annular outward facing groove or undercut 77. A ring 78 is clamped to the upper edges of the portions 76 by C-shaped members 79 and screws 81. The members 79 are located peripherally by recesses 183 at the top of the ring and are arranged in cut-away part 85 of the ring so as to fit within its outside diameter (see FIG. 2).

Before the dial 62 is trick-cut, the upstanding flange which is to form portion 76 is recessed. The dial 62 is then trick-cut and the ring 78 can be fitted. The ring 78 has screwed to it a key 80 to engage in a keyway 6 in the cylinder 2. The ring 78 is angularly adjustable with respect to the dial before the screws 81 are operated to cause the C-shaped member 79 to clamp the ring 78 and dial 62 together. The ring 78 has a flange or shoulder 87 engaging a complementary shoulder 75 of the trick body portion to ensure that ring is at all times concentric with the dial 62. The outside of the ring 78 fits and is located by the radially inner face of the cylinder 2 so as to ensure that the dial 62 is held concentric to the cylinder 2. Consequently the cam system 20 is also held centrally in the cylinder firstly by means of the needle dial 62 being held concentrically in it and secondly by the cam system being journalled through the bush 68 on the dial 62.

The dial 62 has an approximately conical shape so as to provide a conical space 91 for receiving the lower end of the dropper 19 when the dropper 19 is in the upper retracted position. In this position the points 25 of the dropper do not touch the fabric as it is being taken down during rotary knittng. The dropper is only lowered after reciprocatary knitting has been completed. The tricks 60 with parallel side walls 74 for the terry instruments are also at an angle to the horizontal. The cam system 20 hence, whilst moving the instruments radially in or out, also causes the projecting ends of the terry instruments to have a component of movement in a vertical direction. By setting the ring 78 and member 79 terry instruments 91 can be located accurately midway between adjacent needles and by their inclined mounting the terry instruments 91 can be brought to a relatively low position between the needles as the needles are drawing terry loops. It becomes hence feasible to use the mechanism for knitting relatively short terry loops on relatively fine fabric.

The cam system 20 can be made simple and be mounted well inside the hollow space in the cylinder 2. The terry mechanism does not interfere with the fabric take down and terry instruments can be accurately controlled without much risk of distortion or deflection of the instruments due to their excessive lengths.

The terry instruments 91 have smooth pointed ends 90 and butts 94. The butts 94 are arranged so as to extend vertically upwards when the instruments are in the dial 62. This facilitates the machining of the cam system 20. The instruments move at approximately 20° to the horizontal.

The cam system 20 (FIG. 2) has firstly a slope 181 for retracting all terry instruments at all times to the radially innermost position in which the ends 90 are withdrawn in the trick to a cast off position leaving the exterior of the bed 62 smooth.

When no terrying is desired and the bolt cam 55 is fully withdrawn in its uppermost position by the member 38, cam slopes 189 will bring the instruments to the normal 'knitting' position in which the ends 90 will act as orthodox verge bits helping to form loops when two or more needles drawn loops in the top cylinder 2. The slope 181 will bring all terry instruments to the radially innermost position and the points 90 of the terry instruments will stay retracted whilst functions other than knitting are in progress during a revolution of the cylinders. In this mode the knitting machine can knit all the usual fabrics which it is capable of knitting including broad-rib.

When all-round terry is desired for knitting terry for the whole course length, the bolt cam 55 is projected firstly engaging the high butts only and secondly lowered further to engage also the low butts. Thus all terry instruments will be brought to the fully projected position by the bolt cam 55. The bolt cam 55 will project terry instruments, which have already been projected by cam shoulder 89, to the 'terry' position. The cam ring 54 with its retracting slope 185 will move the terry instruments radially inwards after yarn has been fed both to the needles directly below the projected terry instruments to form the ground fabric and after yarn has been fed over the top of the projected terry instruments to the hooks of the needles to form terry loops in two stages.

The slope 185 causes early retraction of the terry instruments to cause the instruments to miss the rib needle cross-over on an associated latchguard (not shown) and permits the latchguard surface to be in place to prevent turning of the rib needle latches. Whilst the half withdrawn instruments do not cast off the terry loops once they have been formed over fully projected instruments, the half withdrawn position permits normal knitting if the bolt-cam 55 is withdrawn as described previously.

After the needles have been fully lowered and reached their knock over position, the retracting slope 181 returns the terry instruments to the fully retracted position. The outer cam ring 54 will have further retracting slopes 183 and 91 to bring the terry instruments radially inward in the reverse direction of rotation during the formation of a reciprocated heel or toe-pouch. Depending on requirements the bolt cam may have a constant radius between the slopes 185 and 91 or it may be recessed or even formed as two separate bolt cams so as to permit the terry instruments to be withdrawn temporarily between the slopes 185 and 91. Which precise arrangement is adopted depends on the latch guard configuration.

For half round or selective terry, the bolt cam 55 is half lowered to engage long butts only. For half round terry in the heel, the cam 55 engages butts 94 on the heel-half only. Otherwise operation is as described previously.

The terry mechanism operates otherwise to knit terry fabric in a manner similar to that described in British Patent Specification No. 567,620 and so not described any further here.

It is important to note that the pointed free ends of the terry instruments can act in the same way as the conventional verge bits so as to hold fabric under control whilst fabric is being knitted by more than two needles controlled by sliders in the top cylinder 2.

The terrying mechanism of the invention requires only minimal modification of a top cylinder assembly and can be used to knit terry fabric in a variety of modes including the knitting of heel pouches or toe pouches. The cam system is simple and compactly mounted and the terry instruments are accurately located in the congested area between the top and bottom cylinder. The downward inclination of the terry instruments, apart from permitting a compact mounting, not interfering with normal take down mechanisms, may ease feeding angles instruments may be replaced through a door or slot in cam ring 54. Using a slot arrangement, the needle bed 62 and cam system 20 may be lowered against the bias of the springs 28, to enable the butt of the instrument to be drawn out between the needle bed 62 and top cylinder 2.

The cam system may alternatively by arranged to oscillate to lag behind the cylinder as described in the British Patent Specification No. 567,620 without departing from the invention.

The terrying mechanism can be fitted simply by first locating the ring 78 in the cylinder 2 and then moving the whole assembly up into the cylinder and securing it by means of the bush 24.

The terry instruments have an end with a slightly-upturned nose to pull the yarn inwards and into the needles hooks prior to the yarn falling off the instruments. It has also been found surprisingly that by shifting the ground yarn feed position forward and reverse plating can sometimes be obtained selectively.

What is claimed is:

1. Terrying mechanism for mounting in one cylinder of superimposed double cylinder knitting machine, said mechanism including:

a pillar for arranging in alignment with a central axis of said one cylinder and for arranging in its interior, said pillar having means at its upper end for holding the pillar against rotation;

an annular cam system mounted on the pillar, a retractable cam means incorporated in the annular cam system;

a dial having a tricked body having trick walls defined by tricks extending radially, terry instruments in the tricks having butts for operation by said annular cam system, and means for coupling the tricked body to said one cylinder, bearing means supporting said dial rotatably with respect to the annular cam system and the pillar;

a key means associated with said dial;

a toe-pouch tensioner having a shaft extending through aligned openings in the pillar and said dial to permit axial sliding movement but engaged by the key means for conjoint rotation with the dial, said means for coupling the tricked body to said one cylinder including a ring fastened concentrically to the tricked body against free ends of said trick walls, and further key means located in the ring for causing said dial and said one cylinder to rotate conjointly, said ring and trick walls having mutually engageable shoulders to center the ring and tricked body, a projection provided on the trick walls and defining an undercut, and clamping means engaging the undercut for securing the ring and tricked body in any desired angular relationship.

2. Terrying mechanism as claimed in claim 1 further characterized by a hollow stub fastened to the tricked body and aligned with the pillar to support said bearing means and rotatably supporting said dial, and fastening means separably secure said hollow stub to said tricked body and a member secured to the stub on the end opposite that of the tricked body retains said dial against axial movement with respect to the annular cam system.

3. Terrying mechanism as claimed in claim 1 wherein the tricked body as a central recess for receiving said toe-pouch tensioner and said tricks defining the trick walls have a longitudinal direction radial but at an angle to the axis to thereby cause the terry instruments to project from the tricked body at a level below that of the toe-pouch tensioner when received in said central recess.

4. Terrying mechanism as claimed in claim 1 wherein the retractable cams means includes a cam with a pair of slopes for projection of the terry instruments prior to knockover in either direction of cylinder rotation.

5. Terrying mechanism as claimed in claim 1 wherein said cam system includes a base plate, a slideway in the base plate for the retractable cam and a pair of rings secured to the base plate having flanges for defining an annularly extending cam track.

6. Terrying mechanism as claimed in claim 1 wherein the pillar has resilient means at its upper end to bias the pillar axially and means are provided for adjusting the level of the dial in said one cylinder and thereby the terry instrument operating level.

7. Terrying mechanism as claimed in claim 6 wherein the pillar has adjustment means at its upper end for holding it against rotation in any one of a range of positions.

8. Terrying mechanism as claimed in claim 2 wherein the pillar has an annular flange means removably connected to the annular cam system, a recess intermediate the flange means and the annular cam system housing the said retaining member at the top of the hollow stub, said key means being arranged to extend through a slot in the hollow stub below the said retaining member.

9. Terrying mechanism for mounting in one cylinder of superimposed double cylinder knitting machine, said mechanism including:

a pillar for arranging in alignment with a central axis of said one cylinder and for arranging in its interior, said pillar having means at its upper end for holding the pillar against rotation;

an annular cam system mounted on the pillar, a retractable cam means incorporated in the annular cam system;

a dial having a tricked body having trick walls defined by tricks extending radially, terry instruments in the tricks having butts for operation by said annular cam system, and means for coupling the tricked body to said one cylinder including a ring fastened concentrically to the tricked body against free ends of said tricked walls and key means located in the ring for causing said dial and said one cylinder to rotate conjointly, a hollow stub fast to the tricked body and aligned with the pillar to thereby mount the dial rotatably with respect to the annular cam system and the pillar;

further key means associated with the hollow stub interior;

a toe-pouch tensioner having a shaft extending through aligned openings in the pillar and the stub to permit axial sliding movement but engaged by the further key means for conjoint rotation with the dial, said ring and trick walls defining mutually engageable shoulders to center the ring and tricked body, a projection being provided on the tricked walls with an undercut, and clamping means engaging the undercut to secure the ring and tricked body in any desired relative angular relationship.

10. Terrying mechanism for mounting in one cylinder of super imposed double cylinder knitting machine, said mechanism including:

a pillar for arranging in alignment with a central axis of said one cylinder and for arranging in its interior, said pillar having means at its upper end for holding the pillar against rotation;

an annular cam system mounted on the pillar, a retractable cam means incorporated in the annular cam system;

a dial having a tricked body having trick walls defined by tricks extending radially, upward projections on the trick walls, undercuts in the upward trick wall projections, terry instruments in the tricks having butts for operation by said annular cam system, and a ring fastened concentrically to the tricked body against free ends of said upward projections of said trick walls above the level of the instruments, shoulders provided on said ring and said upward trick wall projections respectively engaging mutually to center the ring and tricked body, first key means in said ring for coupling the ring to said one cylinder for conjoint rotation, clamping means engaging the undercut and mutually securing the ring and tricked body in any one of a range of desired relative angular relationships to fix the terry instruments angularly with respect to the cylinder, a hollow stub fast to the tricked body extending upward through the annular cam system to support it for relative rotational movement and aligned with the pillar to thereby mount the dial rotatably with respect to the annular cam system and the pillar;

a second key means connected to the dial and directed radially inwards of the hollow stub interior; and a toe-pouch tensioner having a shaft extending through aligned openings in the pillar and the stub to permit axial sliding movement but engaged by the second key means for conjoint rotation with the dial.

11. Terrying mechanism as claimed in claim 10 wherein fastening means separably secure said hollow stub to said tricked body and a retaining member secured to the stub on the end opposite that of the tricked body retains said dial against axial movement with respect to the annular cam system located between the dial and the retaining member and the pillar is connected to the annular cam system for joint location of the annular cam system and tricked body axially with respect to said cylinder.

12. Terrying mechanism as claimed in claim 11 wherein the pillar has annular flange means removably connected to the annular cam system, a recess intermediate the flange means and the annular cam system houses the said retaining member at the top of the hollow stub, and the second key means is arranged to extend through a slot in the hollow stub below the said retaining member.

13. Terrying mechanism as claimed in claim 10 wherein the tricked body has a central, substantially conical recess for receiving said toe-pouch tensioner in its upper inactive attitude and said tricks defining the trick walls have a longitudinal direction radial but at an angle to the axis and substantially parallel to the wall of said central conical recess to thereby cause the terry instruments to project from the tricked body at a level below that of the toe-pouch tensioner when received in said central recess in its upper inactive attitude.

14. Terrying mechanism as claimed in claim 10 wherein the retractable cam means includes a cam with a pair of slopes for projection of the terry instruments prior to knockover in either direction of cylinder rotation.

15. Terrying mechanism as claimed in claim 10 wherein said cam system includes a base plate, a slideway in the base plate for the retractable cam and a pair of rings secured to the base plate having flanges for defining an annularly extending cam track.

16. Terrying mechanism as claimed in claim 10 wherein the pillar has resilient means at it upper end to bias the pillar axially and means are provided for adjusting the level of the dial in said one cylinder and thereby the terry instrument operating level.

17. Terrying mechanism as claimed in claim 15 wherein the pillar has adjustment means at its upper end for holding it against rotation in any one of a range of positions.

18. Terrying mechanism as claimed in claim 16 wherein shoulders are provided on said ring and trick walls respectively, engaging mutually to center the ring and tricked body, a projection is provided on the trick walls forming said free ends and having an undercut and clamping means engaging the undercut mutually secure the ring and tricked body in any one of a range of desired relative angular relationships.

19. Terrying mechanism for mounting in one cylinder of superimposed double cylinder knitting machine, said mechanism including:

a pillar for arranging in alignment with a central axis of said one cylinder and for arranging in its interior, said pillar having means at its upper end for holding the pillar against rotation;

an annular cam system mounted on the pillar, a retractable cam means incorporated in the annular cam system;

a dial having a tricked body having trick walls defined by tricks extending radially, terry instruments in the tricks having butts for operation by said annular cam system, and means for coupling the tricked body to said one cylinder for conjoint rotation, a hollow stub fast to the tricked body and extending upward through the annular cam system to support it for relative rotationally movement and alinged with the pillar, fastening means separably securing the hollow stub to said tricked body, a retaining member secured to the stub on an end opposite that of the tricked body for retaining the annular cam system between the member and the dial for relative rotational movement and against axial movement to thereby mount the dial rotatably with respect to the annular cam system and the pillar;

a key means connected to the dial and stub directed radially inwards of the hollow stub interior; and a toe-pouch tensioner having a shaft extending through aligned openings in the pillar and the stub to permit axial sliding movement but engaged by the key means for conjoint rotation with the dial.

20. Terrying mechanism as claimed in claim 19 wherein the pillar has annular flange means removably connected to the annular cam system, a recess intermediate the flange means and the annular cam system houses the said retaining member at the top of the hollow stub, and said key means arranged to extend through a slot in the hollow stub below the said retaining member.

21. Terrying mechanism as claimed in claim 19 wherein said means for coupling the tricked body to said one cylinder include a ring fastened concentrically to the tricked body against free ends of said trick walls above the level of the instruments and further key means in the ring for causing said dial and said one cylinder to rotate conjointly.

22. Terrying mechanism as claimed in claim 21 wherein shoulders are provided on said ring and trick walls respectively enagaging mutually to center the ring and tricked body, a projection is provided on the trick walls forming said free ends and having an undercut and clamping means engaging the undercut mutually secure the ring and tricked body in any one of a range of desired relative angular relationships.

23. Terrying mechanism as claimed in claim 19 wherein the tricked body as a central substantially conical recess for receiving said toe-pouch tensioner in its upper inactive attitude and said tricks defining the trick walls have a longitudinal direction radial but at an angle to the axis and substantially parallel to the wall of said central conical recess to thereby cause the terry instruments to project from the tricked body at a level below that of the toe-pouch tensioner when received in said central recess in its upper inactive attitude.

24. Terrying mechanism as claimed in claim 19 wherein the retractable cam means includes a cam with a pair of slopes for projection of the terry instruments prior to knockover in either direction of cylinder rotation.

25. Terrying mechanism as claimed in claim 19 wherein said cam system includes a base plate, a slideway in the base plate for the retractable cam and a pair of rings secured to the base plate having flanges for defining an annularly extending cam track.

26. Terrying mechanism as claimed in claim 19 wherein the pillar has resilient means at its upper end to bias the pillar axially and means are provided for adjusting the level of the dial in said one cylinder and thereby the terry instrument operating level.

27. Terrying mechanism as claimed in claim 26 wherein the pillar has adjustment means at its upper end for holding it against rotation in any one of a range of positions.

28. Terrying mechanism for mounting in one cylinder of superimposed double cylinder knitting machine, said mechanism including:

a pillar for arranging in alignment with a central axis of said one cylinder and for arranging in its interior, said pillar having means at its upper end for holding the pillar against rotation;

an annular cam system mounted on the pillar, a retractable cam means incorporated in the annular cam system;

a dial having a tricked body having trick walls defined by tricks extending radially, said tricked body having a central, substantially conical recess and said tricks having a longitudinal direction radial but at an angle to the axis and substantially parallel to the wall of said central conical recess, terry instruments in said tricks having upturned projecting ends for projecting at the lower end of said recessed body for operation by said annular cam system and means for coupling the tricked body to said one cylinder, a hollow stub fast to the tricked body extending upwardly through the annular cam system to support it for relative rotational movement and aligned with the pillar to thereby mount the dial rotatably with respect to the annular cam system and the pillar;

a key means connected to the dial and stub and directed radially inwards of the hollow stub interior and a toe-pouch tensioner having a shaft extending through aligned openings in the pillar and the stub to permit axial sliding movement from a upper retracted inactive position and a star-like downwardly sloping fabric engaging end wherein the fabric engaging end of the toe-pouch tensioner is received inside the conical recess in the tricked body in an upper inactive attitude and is movable to an active lowered position for tensioning toe-pouch fabric but engaged by the key means to ensure conjoint rotation of the toe-pouch tensioner with the dial.

29. Terrying mechanism as claimed in claim 28 wherein said means for coupling the tricked body to said one cylinder include a ring fastened concentrically to the tricked body against free ends of said trick walls above the level of the instruments and further key means located in the ring for causing said dial and said one cylinder to rotate conjointly.

30. Terrying mechanism as claimed in claim 28 wherein fastening means separably secure said hollow stub to said tricked body and a retaining member secured to the stub on the end opposite that of the tricked body retains said dial against axial movement with respect to the annular cam system located between the dial and the retaining member and the pillar is connected to the annular cam system for joint location of the annular cam system and tricked body axially with respect to said cylinder.

* * * * *